United States Patent [19]

Cesari

[11] Patent Number: 4,759,381

[45] Date of Patent: Jul. 26, 1988

[54] TOOTHBRUSH WITH TOOTHPASTE CONTAINER

[76] Inventor: Giuseppe Cesari, Via Nani no. 17, Bologna, Italy

[21] Appl. No.: 870,487

[22] Filed: Jun. 4, 1986

[30] Foreign Application Priority Data

Jun. 4, 1985 [IT] Italy ..... 4919/85[U]

[51] Int. Cl.[4] ..... A45D 44/18

[52] U.S. Cl. ..... 132/84 B; 132/84 D; 401/175; 401/191; 401/84

[58] Field of Search ..... 132/84 B, 84 D, 84 R; 401/270, 271, 272, 191, 171, 176, 177, 179, 181, 182, 175, 174; 15/167 R, 167 A

[56] References Cited

U.S. PATENT DOCUMENTS

| | | | |
|---|---|---|---|
| 902,796 | 11/1908 | Archer et al. | 132/84 B |
| 1,207,121 | 12/1916 | Zeidler | 401/271 |
| 1,659,628 | 2/1928 | Greenblatt | 132/84 B |
| 1,988,557 | 1/1935 | Jecker | 401/271 |
| 2,243,774 | 5/1941 | Resh | 401/179 |
| 2,488,638 | 11/1949 | O'Connor | 401/179 |
| 2,587,794 | 3/1952 | Walker et al. | 401/176 |
| 3,378,176 | 4/1968 | Snyder | 401/182 |
| 3,741,667 | 6/1973 | Cesari | 132/84 B |
| 4,201,490 | 5/1980 | D'Angelo | 401/270 |

*Primary Examiner*—Gene Mancene
*Assistant Examiner*—Adriene J. Lepiane
*Attorney, Agent, or Firm*—Martin A. Farber

[57] ABSTRACT

Toothbrush with toothpaste container consisting of a body, having the function of case and support of the toothbrush, and of a toothpaste container; a housing for the toothbrush in the case allows delivery of the toothpaste onto the bristles, when the toothbrush is closed. By pushing a button housed on the cover of the container, metering of the toothpaste is performed, and the quantity dispensed is controlled by the pressure inside the dispenser.

1 Claim, 1 Drawing Sheet

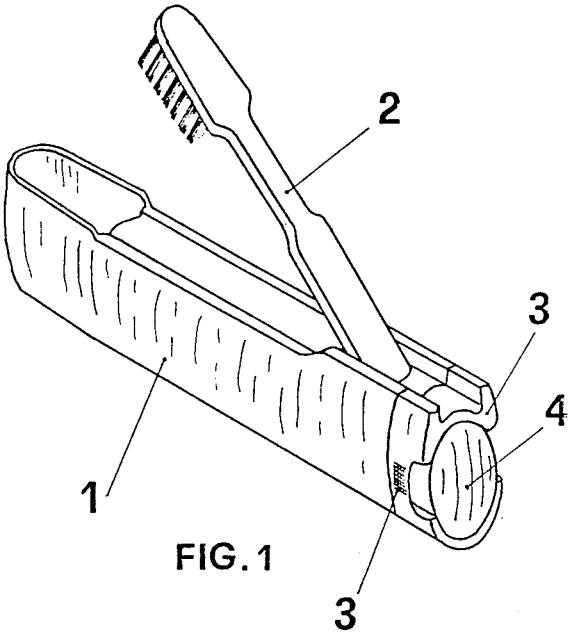
FIG. 1
FIG. 2
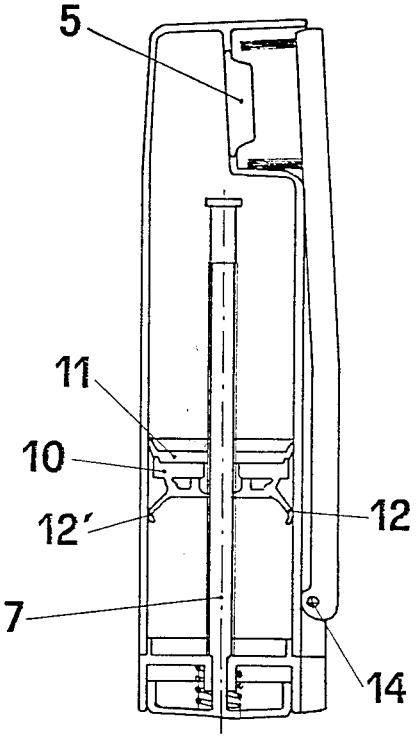
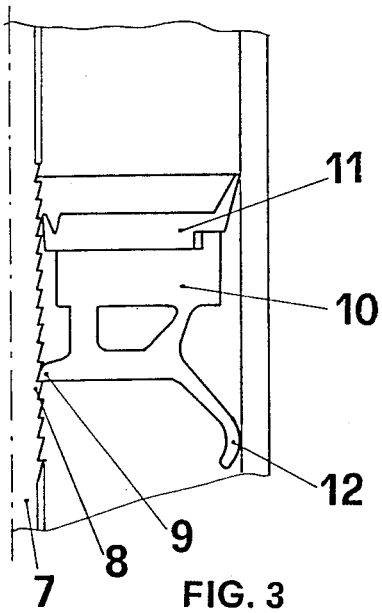
FIG. 3
FIG. 4
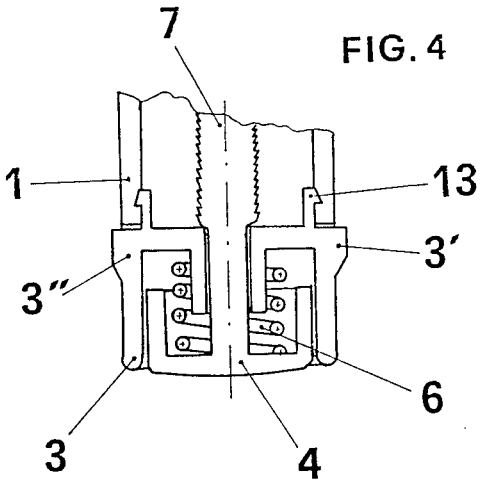

TOOTHBRUSH WITH TOOTHPASTE CONTAINER

The invention relates to a toothbrush with a removable container delivering toothpaste.

It is known that toothbrushes are available today on the market which are normally used by supplying the toothpaste from an external tube suitable for dispensing the toothpaste itself onto the brush bristles. All that involves a certain manipulation of different elements and a waste of time in performing the use and maintenance operations of the toothbrush itself as well as the space occupied.

On the market there are also toothbrushes which are of similar type to the object of this invention, but they have some defects.

First of all, the latter consist of two elements connected, i.e. the actual toothbrush and body in which the toothpaste is kept (container). For these currently marketed toothbrushes the operations of filling the container with toothpaste are remarkably troublesome. Moreover, the final section of the toothpaste delivering system of the currently marketed toothbrushes is shaped in such a way to make the paste itself dry quite easily. And also, cleaning the device is rather difficult, especially with regard to the toothpaste container. And this can be inconvenient particularly when a change of the toothpaste is required or wished.

It is one object of the present invention to provide a construction of a toothbrush with case and toothpaste delivering system with removable container.

It is another object of this model to allow the construction of a toothbrush fitted with a very simple delivering mechanism and with equally simple components in order to achieve low production costs.

Additional purposes and advantages will be understood by the following description and by the accompanying drawing showing a preferred embodiment of the invention schematically and by way of example, in which:

FIG. 1 shows in perspective view the toothbrush partially closed;

FIG. 2 shows a longitudinal section of the toothbrush closed;

FIG. 3 shows a broken-away section of the basic components of the delivering and metering system of the toothpaste; and FIG. 4 shows the end of another longitudinal section of the toothbrush.

Toothbrush 2 hinged or articulated on a hinge 14 is connected to a body-case 1, suitably shaped to be easily held when closing the toothbrush 2 in the body. The toothbrush inserts into that body-case and at the same time provides a cover to the corresponding hollow of the case itself. Said body-case 1 has also the function of a container of toothpaste and is moreover fit to house the toothpaste delivering system.

A closing component 3 houses a control component of the toothpaste delivering system 4 (button). Said closing component 3 can be connected to body 1 in different ways, all suitable for the purpose. The connection shown in the drawing is effected by means of claws 13, that engage into the marks or notches formed inside body 1. Component 3 is disconnected from the body 1 by exerting pressure on components 3' and 3'', which causes the release of claw 13 from body 1, due to the elasticity of closing component 3. After performing the disconnection, the whole toothpaste delivering system 4 can be taken out of the container. Thus the operations of cleaning the container and loading the toothpaste can be very easily carried out.

Furthermore should the bristles wear out, the head of toothbrush 2 shall be replaced by unfastening hinge 14, while the body 1 of the toothbrush 2 is kept.

When toothbrush 2 is located in the hollow of body 1, the exertion of pressure on button 4 causes the toothpaste to be ejected from dispenser 5 and to get mixed directly with the bristles of the toothbrush 2. The counteraction of a spring 6 is overcome by exerting pressure on button 4 and thus rod 7 moves on.

The side surface of said rod 7 has a saw-toothed edge 8: when the rod moves on, tooth 8 engages into countertooth 9 of support 10 of diaphragm piston 11. Since piston 11 seals the inner surface of the walls of body 1, the actual volume of the container is reduced and the toothpaste is ejected from dispenser 5. When pressure is released on button 4, the spring 6, being compressed between the closing component 3 and the button 4, brings back said button 4 and rod 7, integrally connected to it, to rest position. The reversal movement of the rod 7 does not go hand in hand with the reversal movement of support 10 and that of piston 11: in fact, one tooth is skipped with the countertooth 9 being jumped over and engaging into the subsequent tooth 8. Said operation is made possible due to the elasticity of fins 12 and 12'. Said fins 12 and 12' also have the task of assuring constant centering of the whole metering mechanism of the toothpaste within the container. Piston 10 serves the purpose of preventing the toothpaste from seeping out and the air from entering the container, thus preventing the paste from drying out. Dispenser 5 is elastic and a sufficient obstacle to air intake, as its holes widen out only when toothpaste is dispensed by pressing the button 4 and close when the pressing is stopped.

The toothpaste thrust mechanism turns out to be made as a single part, by elimination of the worm screw. The consequent higher simplicity of mechanics makes it possible to achieve lower production costs.

The present invention illustrated and described schematically and by way of example, shall be construed as comprising those accessory variants which, as such, fall within its scope.

I claim:

1. In a toothbrush connected with a toothpaste container containing toothpaste therein for dispensing on the toothbrush, the improvement wherein said container comprises an elongated hollow container body having one open end, a closing component at and closing said one end of the container body, a dispenser at an other end, a rod being slidably inserted through said closing component into said container body, and a piston disposed slidably sealingly inside said container body defining space for the toothpaste between said piston and said dispenser, the piston being mounted on said rod so as to be movable only in one-way movement toward the dispenser at the other end of the container body pushing the toothpaste in said space in the container body through said dispenser when said rod is pushed toward said dispenser, said toothbrush adjacent one end thereof is releasably hinged adjacent said one end of the container body, said toothbrush has bristles at the other end of the toothbrush, said bristles have free ends which are located oppositely facing and adjacent said dispenser when the toothbrush is in a closed position against said container, the latter forming a container case for the toothbrush to be disposed therein in said closed position, and said bristles are located away from said dispenser when the toothbrush is in an open position out of said container case, said closing component substantially completely closes said one end of the container body and is mounted releasably and complete removable from, and thereby opening, said one end of the container body for easy access to the inside as well as said other end of the container body through the open said one end, said closing component has a resilient, substantially cylindrical portion and resilient claws, the latter releasably engaging into notches formed in an inside wall surface of the container body adjacent said one end, said resilient cylindrical portion being pressable so as to disengage said resilient claws for releasing and removing said closing component from said one end of the container body, said rod has a button at said one end pushable by a person's finger toward the dispenser, said button being slidably mounted in said cylindrical portion of said closing component, said cylindrical portion having an open end through which said button projects, spring means mounted between said closing component and said button biasing the latter in a direction away from said dispenser, said rod on opposite sides is formed with a saw-toothed edge forming a plurality of teeth, said piston comprises an annular central support portion spaced apart from an inside wall surface of the container body and spaced apart from said rod, said piston comprises an annular tooth-fin section facing said one end of the container body and connected to said central support portion by spaced-apart tabs, said tooth-fin section has a central opening forming with a single tooth pointing toward said one end of the container body and complementarily engaging respective of said teeth of the rod in such manner as to push the piston when the button is pushed toward the dispenser, and said tooth-fin section at its periphery has flexible fins with curved ends, the latter at a curving portion thereof slidingly sealingly engaging against said inside wall surface of the container body, said fins pointing substantially toward said one end of said container body, said piston further comprises a diaphragm piston section facing the other end of said container body, said diaphragm piston section having at its periphery flexible diaphragm lips with points substantially pointing toward said other end of said container body, said points slidably engaging said inside wall surface, said diaphragm piston section further comprising inner lips pointing toward said other end of said container body and slidably engaging said rod and said teeth of said rod, said dispenser is elastic and openable so as to dispense toothpaste therethrough directly onto the free ends of said bristles when the toothbrush is in said closed position in said container case when pushing the button and respectively closable when the button is released.

* * * * *